US006789872B2

(12) United States Patent
Ioka et al.

(10) Patent No.: US 6,789,872 B2
(45) Date of Patent: Sep. 14, 2004

(54) IMAGE RECORDING APPARATUS

(75) Inventors: Ken Ioka, Hachioji (JP); Yasuhiro Komiya, Hino (JP); Toshiyuki Ebihara, Hino (JP); Seiji Tatsuta, Hachioji (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 10/393,509

(22) Filed: Mar. 20, 2003

(65) Prior Publication Data

US 2004/0090475 A1 May 13, 2004

(30) Foreign Application Priority Data

Mar. 28, 2002 (JP) ..... 2002-091939

(51) Int. Cl.[7] ..... B41J 29/393
(52) U.S. Cl. ..... 347/19
(58) Field of Search ..... 347/19, 5, 1, 7, 347/20, 9; 702/94, 85; 73/1.01, 1.79

(56) References Cited

U.S. PATENT DOCUMENTS 6,045,210 A 4/2000 Suzuki et al.
6,179,402 B1 1/2001 Suzuki et al.
6,247,780 B1 * 6/2001 Matsubara et al. ..... 347/19

FOREIGN PATENT DOCUMENTS

JP 2002-079657 A 3/2002
JP 2002-096462 A 4/2002
JP 2002-144542 A 5/2002
JP 2002-292859 A 10/2002
JP 2002-307666 A 10/2002

* cited by examiner

*Primary Examiner*—Raquel Yvette Gordon
(74) *Attorney, Agent, or Firm*—Frishauf, Holtz, Goodman & Chick, P.C.

(57) ABSTRACT

An image recording apparatus is provided which includes a test pattern reader for reading a test pattern image recorded by respective recording heads; an image recording position error detector for detecting, from the read test pattern, an error in image recording position for each recording element of each recording head relative to a predetermined image recording position; a correction data generator for producing correction data for correcting the error in image recording position for each recording element of each recording head in accordance with the detected recording position error; a correction unit for correcting an image signal to be recorded by each recording element of each recording head, on the basis of the produced correction data; and a controller for operating the test pattern reader, the image recording position error detector, and the correction unit at a particular time.

14 Claims, 5 Drawing Sheets

IMAGE RECORDING APPARATUS

This application claims the benefit of Japanese Application No. 2002-091939 filed in Japan on Mar. 28, 2002, the entire contents of which are incorporated herein by reference.

This application claims benefit of Japanese Application No. 2002-91939 filed in Japan on Mar. 28, 2002, the contents of which are incorporated by this reference.

BACKGROUND OF THE INVENTION

1. Field of the Invention

The present invention relates to an image recording apparatus, and more particularly, to an image recording apparatus including a line-type recording head unit formed by connecting a plurality of recording heads and being capable of performing high-speed recording.

2. Description of Related Art

In the art of digital recording apparatuses using an ink-jet recording head (ink-jet printers) or digital recording apparatuses using a thermal transfer recording head (thermal transfer printers), various techniques of correcting density variations in recorded images have been proposed.

One of such techniques is disclosed in U.S. Pat. Nos. 6,045,210 and 6,179,402. In this technique, a recording head of an image recording apparatus comprises a plurality of image recording elements arranged over a range corresponding to a predetermined recording width of a recording medium. In the case of ink-jet printers, for example, variations in shape or other factors among image recording elements (nozzles) of the recording head (printer head) can result in lack of uniformity in size and/or density of recorded dots. Besides, the size and/or density of dots can vary with time. In the image recording apparatus disclosed in U.S. Pat. Nos. 6,045,210 and 6,179,402, in order to solve the above problem, automatic adjustment is made to prevent lack of uniformity in size and/or density of recorded dots and its changes with time.

In order to improve the operation speed and maintainability in conventional image recording apparatuses, an image recording apparatus has been proposed which includes a line-type recording head unit having a plurality of recording heads separated from each other in a width direction of recording medium. A specific example of such an image recording apparatus is a line-head ink-jet printer. In this image recording apparatus, recording elements (nozzles) are disposed on each of the recording heads (print heads), at a pitch corresponding to the resolution on the recording apparatus. In this image recording apparatus, an image is recorded (printed) by scanning relatively to the line-type recording head unit including the plurality of recording heads and the recording medium in a predetermined scanning direction.

In the image recording apparatus disclosed in U.S. Pat. Nos. 6,045,210 and 6,179,402 cited above, the recording density is corrected for each image recording element (nozzle) of a single recording head (print head) included in the image recording apparatus, on the basis of information indicating the number of recorded sheets, the elapsed time, or the like. However, U.S. Pat. Nos. 6,045,210 and 6,179,402 cited above include neither a technical description of correction of a position error caused by lack of uniformity among recording elements of the recording head nor a technical description of correction of a position error which may occur when the recording head is exchanged.

In image recording apparatuses using a line-type recording head unit having a plurality of recording heads, variations in fixing position among recording heads and/or variations in position of recording elements are inevitable. Besides, when one or more recording heads are exchanged for the purpose of maintenance, the exchange may result in a change in fixing position of the one or more recording heads or may result in changes in positions of recording elements. Thus, in order to maintain required high image quality, it is necessary to adjust not only the recording density but also fixing positions of the recording heads and positions of recording elements. In a case in which a single recording head is used, a slight position error or a slight density variation does not have a significant influence on the quality of printed images. However, in a case in which a line-type recording head unit having a plurality of recording heads is used, significant recording positions errors or density variation may result from position errors of recording elements and/or changes in positions due to exchange of recording heads, a temperature change, vibrations (mechanical shock), and/or the like. Thus, it is required to prevent such recording position errors and density variation, in particular, in an area in which nozzles overlap with each other.

SUMMARY OF THE INVENTION

It is an object of the present invention to provide an image recording apparatus capable of always recording a high-quality image by automatically correcting position errors of recording heads thereby preventing degradation in image quality which would otherwise occur due to the position errors of the recording heads.

In brief, the present invention provides an image recording apparatus for recording an image onto a recording medium in accordance with an image signal, using a line-type recording head unit including a plurality of recording heads each having a plurality of recording elements disposed in a predetermined direction, the plurality of recording heads being disposed in substantially the same direction as the direction in which the recording elements are disposed, and the plurality of recording heads being disposed such that there is an overlap in recording width between adjacent recording heads. The image recording apparatus comprises test pattern reading means for reading a test pattern image recorded by the respective recording heads; image recording position error detection means for detecting, from the read test pattern, an error in image recording position relative to a predetermined image recording position for each recording element of each recording head; correction data generation means for producing correction data for correcting the error in image recording position for each recording element of each recording head in accordance with the recording position error detected by the image recording position error detection means; correction means for correcting an image signal to be recorded by each recording element of each recording head, on the basis of the produced correction data; and control means for operating the test pattern reading means, the image recording position error detection means, and the correction means at a particular time.

The above and other objects, features and advantages of the invention will become more clearly understood from the following description referring to the accompanying drawings.

DETAILED DESCRIPTION OF PREFERRED EMBODIMENTS

Embodiments of the present invention are described below with reference to drawings.

Figure 1:
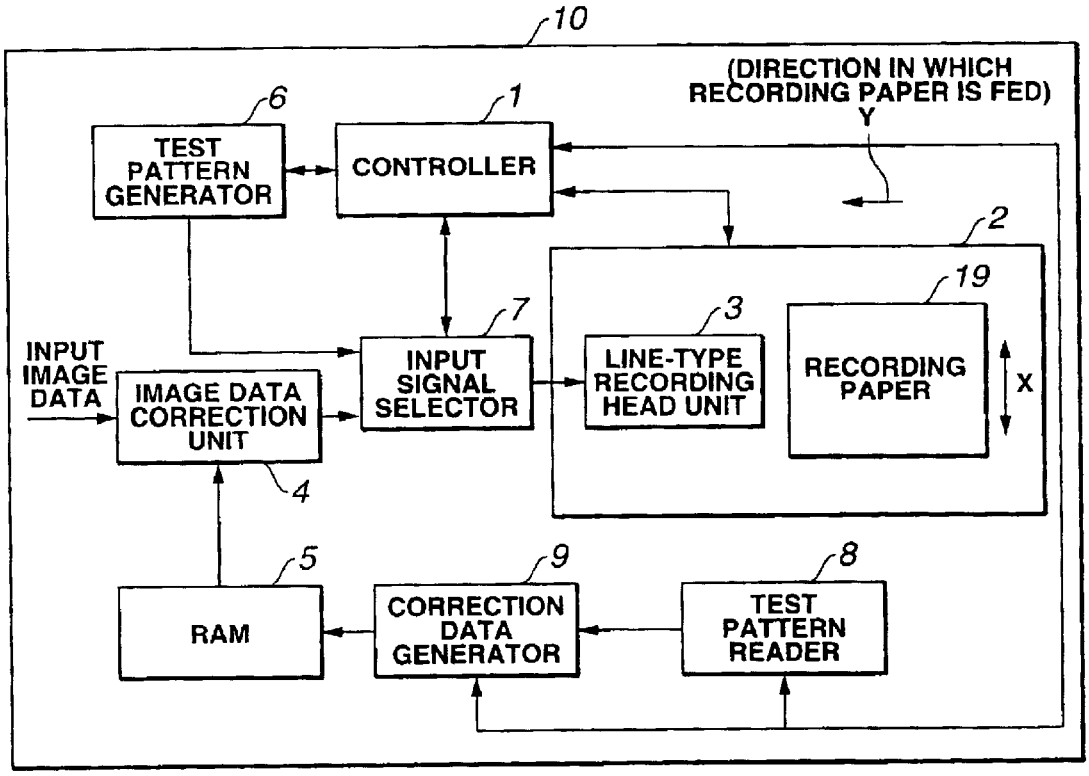
FIG. 1 is a block diagram showing a construction of an image recording apparatus according to a first embodiment of the present invention.
Figure 2:
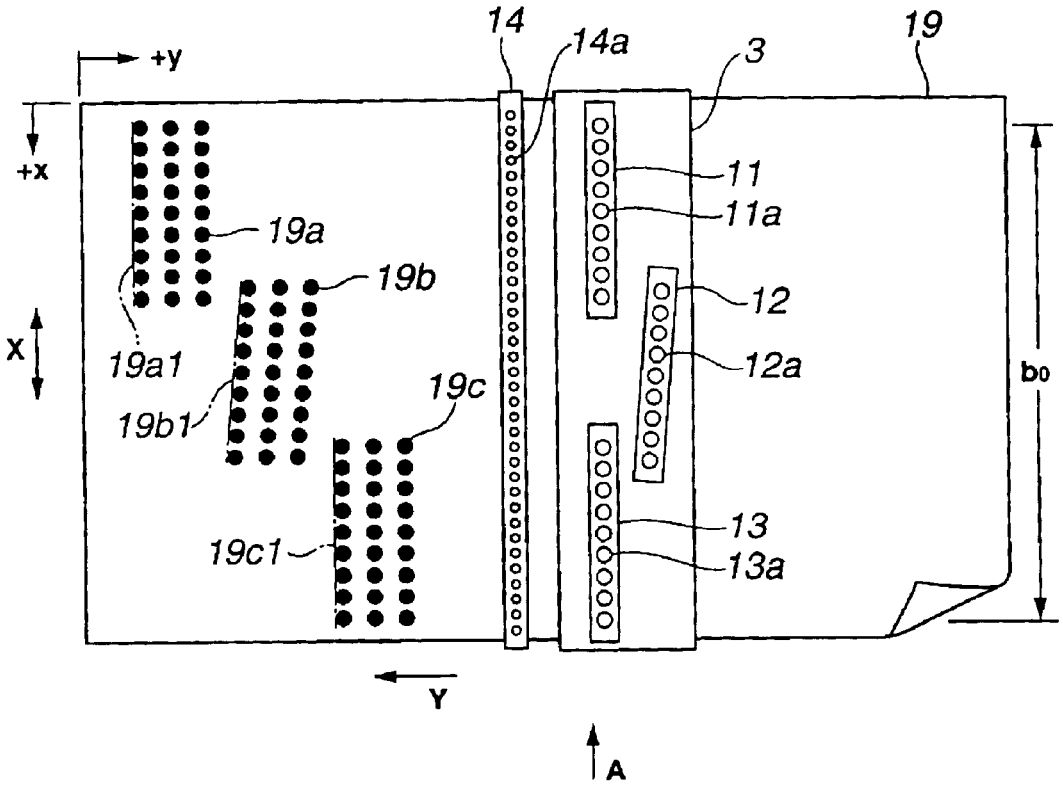
FIG. 2 is a plan view showing a positional arrangement of a print head, a CCD censor, and recording paper, in the image recording apparatus shown in FIG. 1.
Figure 3:
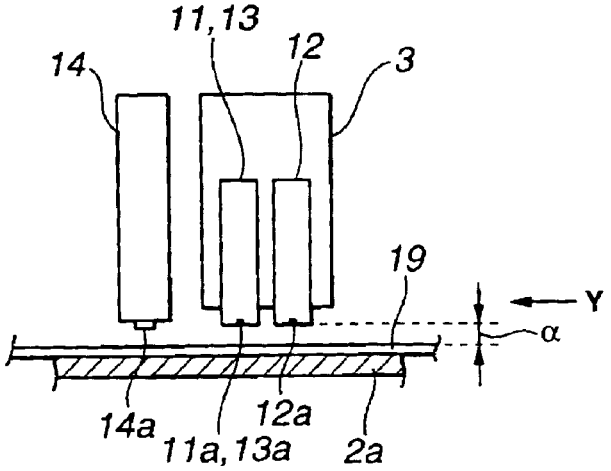
FIG. 3 is a view seen in a direction denoted by an arrow A in FIG. 2.

FIGS. 1 to 3 show a first embodiment of the present invention, wherein FIG. 1 is a block diagram showing a construction of an image recording apparatus according to the first embodiment, FIG. 2 is a plan view showing a positional arrangement of a line-type recording head unit, a CCD sensor, and recording paper, in the image recording apparatus shown in FIG. 1, and FIG. 3 is a view seen in a direction denoted by an arrow A in FIG. 2.

The image recording apparatus 10 according to the present embodiment is an ink-jet printer of the line head type having a line-type recording head unit fixed and supported at a position so as to be capable of recording (printing) over a range corresponding to the width of recording paper, wherein an image is recorded on the recording paper while moving relatively to the head the recording paper in a paper feed direction.

In the following description, the paper feed direction is referred to as a Y direction, and a direction perpendicular to the Y direction, that is, the width direction of recording paper, is referred to as an X direction.

The image recording apparatus 10 includes, as shown in FIG. 1, a controller 1 serving as control means including a CPU and the like responsible for controlling the entire image recording apparatus 10, a recording paper feed mechanism 2 for feeding recording paper 19 serving as a recording medium in the Y direction, a line-type recording head unit 3 fixed and arranged at a location on an upper portion of the recording paper feed mechanism 2, an image data correction unit 4 serving as correction means for correcting, on the basis of correction data, an image signal of input image data to be recorded, a test pattern generator 6 for generating a test pattern under the control of the controller 1, an input signal selector 7 by selecting either the input image data output from the image data correction unit 4 or the test pattern image data output from the test pattern generator and outputting the selected data to the line-type recording head unit 3, a test pattern reader 8 serving as test pattern reading means for, when the test pattern image is printed, reading the printed test pattern, a correction data generator 9 serving as correction data generation means for generating correction data used to correct the input image data on the basis of image recording position error information detected using the test pattern, and an RAM 5 serving as a memory for storing the correction data.

The correction data is data on the basis of which input image data is corrected so as to prevent image recording position errors due to position errors of nozzles of recording heads such as nozzle position errors on the XY plane, vertical nozzle position errors, and/or tilts of nozzles. The nozzle position error not only results in a simple error in position of recorded image or an error in the shape of the recorded image but also a nozzle position error in the X direction may result in superimposing of the image and thus may result in an error in density of the recorded image. Such an error in the density is also prevented by correction on the basis of the correction data.

The recording paper feed mechanism 2 is a paper feed mechanism including a driving belt 2*a* for feeding the recording paper 19 in the Y direction.

The line-type recording head unit 3 includes a plurality of recording heads (three recording heads 11, 12, and 13 in the present example shown in the figures). Each of the recording heads 11, 12, and 13 includes a set of nozzles 11*a*, 12*a*, and 13*a* each serving as a recording element capable of emitting an ink drop with a particular monochromatic color such as black, wherein each set of nozzles is disposed so as to be spaced apart by $\alpha$, as shown in FIG. 3, in a vertical direction (perpendicular to an XY plane) from the recording paper 19. The recording heads 11, 12, and 13 are fixed and supported contiguously in the X direction, as shown in FIG. 2. More specifically, the recording heads 11, 12, and 13 are held such that the nozzles 11*a*, 12*a*, and 13*a* cover a recording range b0 of the recording paper in the X direction and such that a few nozzles in boundary area between adjacent recording heads among the heads 11, 12, and 13 are overlapped in position in the X direction.

The test pattern reader 8 includes a linear CCD 14 capable of reading in a direction of the recording width of the recording paper 9, wherein the linear CCD 14 is disposed at a downstream location immediately adjacent in the Y direction to the line-type recording head unit 3. The test pattern recorded over the recording width b0 is detected by photosensor elements 14*a* of the linear CCD 14 thereby acquiring test pattern data.

The correction data generator 9 produces correction data for correcting input image data, on the basis of the image recording position error information produced by the controller 1 from the test pattern.

The controller 1 includes a control unit responsible for controlling the entire apparatus 10, and also includes image recording position error detection means for detecting an image recording position error from the recorded test pattern image read by the test pattern reader 8.

The process of producing correction data and the process of recording an image performed by the image recording apparatus 10 constructed in the above-described manner according to the present embodiment are described below.

If the position of the recording head 11, 12, or 13 of the line-type recording head unit 3 shifts from its original position when the recording head is exchanged or due to effects of aging, ambient temperature, vibrations, and/or mechanical shocks or for some other reason, an inevitable result is a change in the shape of an image printed in accordance with input data and/or a partial change in the density level of the printed image. In the image recording apparatus 10 according to the present embodiment, if such a change in a recorded image is detected, correction of data is performed.

First, under the control of the controller 1, test pattern image data is outputted from the test pattern generator 6, and sent to the line-type recording head unit 3 via the input signal selector 7. In synchronization with feeding of recording paper 19, ink droplets are emitted from nozzles of the recording heads 11, 12, and 13, thereby recording test patterns 19*a*, 19*b*, and 19*c*, such as those shown in FIG. 2, on the recording paper 19.

Herein, the test pattern 19*a* is a pattern recorded by the recording head 11, the test pattern 19*b* is a pattern recorded by the recording head 12, and the test pattern 19*c* is a pattern recorded by the recording head 13. For example, in a case in which a positional shift occurs in the recording head 12, as in the example shown in FIG. 2, a similar shift occurs in the location of the recorded test pattern 19*b*.

In the above-described recording of the test patterns 19*a*, 19*b*, and 19*c*, the test patterns 19*a*, 19*b*, and 19*c* are recorded such that no overlapping occurs among the test patterns 19*a*, 19*b*, and 19*c* so as to allow position information of the recording heads 11, 12, and 13 to be detected. In the case in which it is necessary to detect position for each of nozzles 11*a*, 12*a*, and 13*a* of the recording heads 11, 12, and 13, the test pattern is recorded by thinning out recording dots thereby creating spaces between adjacent dots.

Although in the above example, the test patterns 19*a*, 19*b*, and 19*c* are recorded on recording paper such that no overlapping occurs among the test patterns 19*a*, 19*b*, and 19*c* and thus such that the test patterns 19*a*, 19*b*, and 19*c* can be distinguished and recognized from each other, the manner in which the test patterns 19*a*, 19*b*, and 19*c* are recorded is not limited to the above example. For example, the respective test patterns may be recorded at different locations on recording paper (recording medium), or the respective test patterns may be recorded using different colors. Alternatively, the number of nozzles may be varied for the respective test patterns such that the dot density of the recorded image varies from pattern to pattern.

The position information of the test patterns 19*a*, 19*b*, and 19*c* is detected by the CCD 14*a* when the test patterns 19*a*, 19*b*, and 19*c* pass under the test pattern reader 8. The position information of the test patterns is acquired by detecting left end lines which constitute edges 19*a*1, 19*b*1, and 19*c*1 of the respective test patterns 19*a*, 19*b*, and 19*c*. The position information is represented by y coordinates in a +y direction (opposite to the Y direction) and x coordinates in a +x direction (parallel to the X direction) with respect to an origin defined at the upper left corner point of the recording paper 19.

The position information of the test patterns 19*a*, 19*b*, and 19*c* is read into the controller 1. From the position information of the test patterns 19*a*, 19*b*, and 19*c*, the controller 1 determines image recording position error information indicating a position error for each recorded dot. The image recording position error information is input to the correction data generator 9. Based on the error indicated by the image recording position error information, the correction data generator 9 produces correction data such that the input image data is recorded without having a position error.

For example, in a case in which the recording head 12 is disposed at a position slanted (shifted) in the +y direction as in the example shown in FIG. 2, shifts of respective nozzles of the recording head 12 in the +y direction are detected from the test pattern 19*b*. Correction data is then produced such that timings of emitting ink droplets from the respective nozzles are delayed by amounts corresponding to the detected shifts in the +y direction. On the other hand, in a case in which displacements (shifts) of nozzles of the recording head 12 in the x direction are detected from the test pattern, correction data is produced such that the amounts of ink droplets emitted are shifted in the x direction by an amount corresponding to the detected shifts.

The recording position error can occur not only due to shifts of nozzles of recording heads within the xy plane but also due to changes in traveling distance of ink droplets or arrival positions of the ink droplets on the recording paper 19, wherein the changes may occur due to vertical shifts of nozzles or changes in inclination of recording heads.

The correction data produced in the above-described manner is stored in the RAM 5.

When recording (printing) of an image on recording paper 19 is started, the image data correction unit 4 reads correction data for the input image data from the RAM 5 and corrects the input image data on the basis of the read correction data. The corrected input image data is output as ink emission data to the line-type recording head unit 3 via the input signal selector 7. The recording paper 19 is fed in the Y direction by the recording paper feed mechanism 2, and ink droplets are emitted by the line-type recording head unit 3 in synchronization with feeding of the recording paper 19 thereby recording (printing) the corrected image.

In the image recording apparatus 10 according to the first embodiment, as described above, a two-dimensional test pattern image actually recorded is read. Correction data is then determined on the basis of the read pattern data, and an image is recorded in accordance with the input image data corrected using the correction data. Thus, even if the recording head 11, 12, or 13 of the line-type recording head unit 3 has a position error, an image can be correctly recorded.

Figure 4:
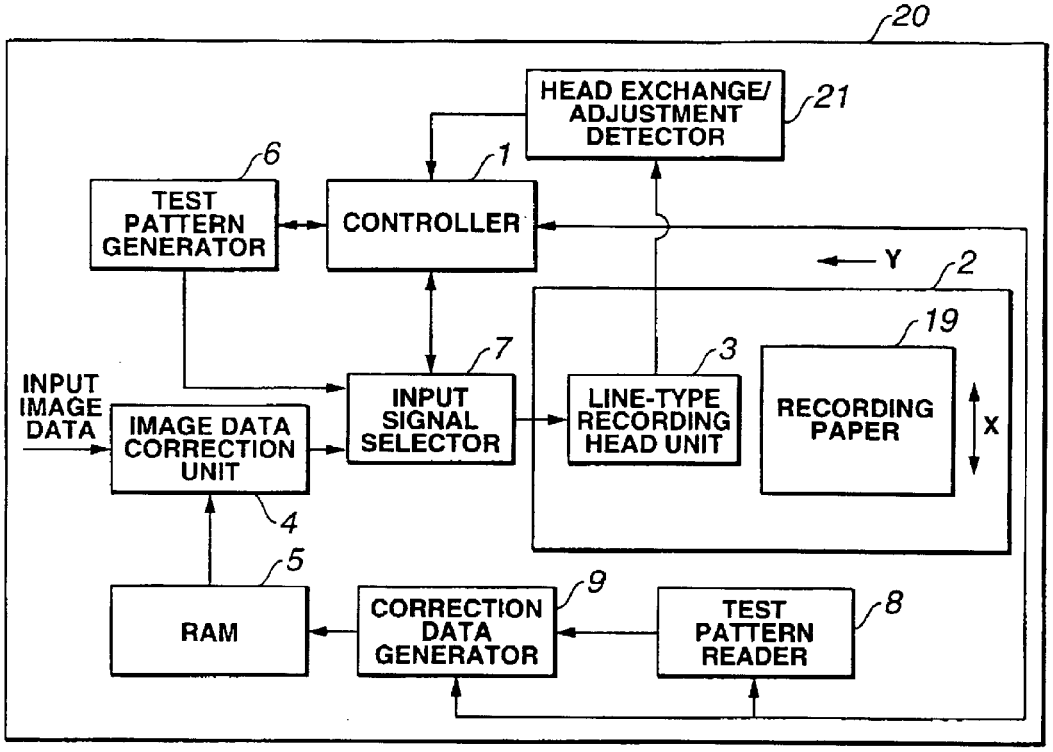
FIG. 4 is a block diagram showing a construction of an image recording apparatus according to a second embodiment of the present invention.

FIG. 4 is a block diagram showing a construction of an image recording apparatus according to a second embodiment of the present invention. In this second embodiment, similar parts to those in the first embodiment described above are denoted by similar reference numerals. In the following description, those similar parts are not explained again but different parts are explained.

The image recording apparatus 20 according to the second embodiment is similar to the image recording apparatus 10 according to the first embodiment described above except that the image recording apparatus 20 additionally has a head exchange/adjustment detector 21.

The head exchange/adjustment detector 21 is included in the line-type recording head unit 3. When one of the recording heads 11, 12, and 13 is exchanged, or when the fixing position of one of the recording heads 11, 12, and 13 is adjusted, a exchange/adjustment detection signal is output from the head exchange/adjustment detector 21 to the controller 1.

In the image recording apparatus 20 according to the present embodiment, if one of the recording heads 11, 12, and 13 is exchanged or if the position of one of the recording heads 11, 12, and 13 is adjusted, the head exchange/adjustment detector 21 outputs a exchange/adjustment detection signal to the controller 1.

If the controller 1 receives the exchange/adjustment detection signal, the controller 1 commands the test pattern generator 6 to produce a test pattern. Thereafter, correction data is produced in a similar manner as in the first embodiment described above. After completion of producing the correction data, the correction data is stored in the RAM 5, and the operation enters into a state in which inputting of image data is waited for. In the above process, when producing of the correction data is completed, the exchange/ adjustment detection signal output from the head exchange/adjustment detector 21 is reset.

In the image recording apparatus 20 according to the second embodiment, advantages similar to those achieved in the image recording apparatus 10 according to the first embodiment described above are achieved. An additional advantage achieved in the second embodiment is that when a head of the line-type recording head unit 3 is exchanged or the position of a head is adjusted, correction data is automatically produced without necessitating that a user should issue a command to generate correction data, and thus the user can use the image recording apparatus 20 in an easier manner.

Figure 5:
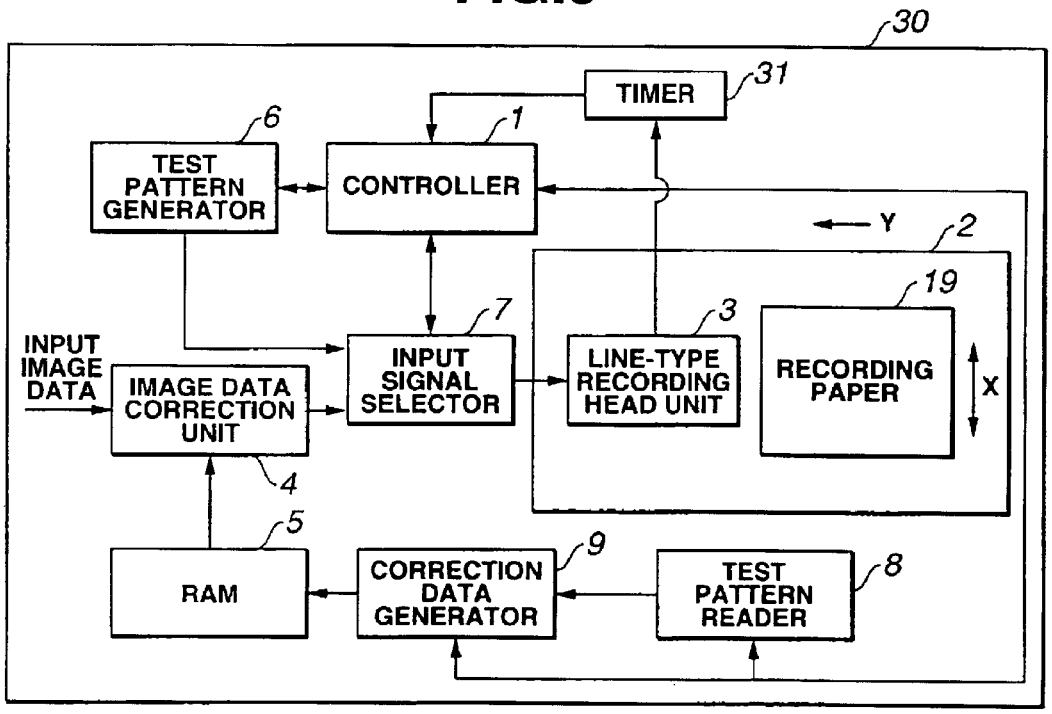
FIG. 5 is a block diagram showing a construction of an image recording apparatus according to a third embodiment of the present invention.

FIG. 5 is a block diagram showing a construction of an image recording apparatus according to a third embodiment of the present invention. In this third embodiment, similar parts to those in the first or second embodiment described above are denoted by similar reference numerals. In the following description, those similar parts are not explained again but different parts are explained.

The image recording apparatus 30 according to the third embodiment is similar to the image recording apparatus 10 according to the first embodiment described above except that the image recording apparatus 30 additionally has a timer 31.

The timer 31 counts the non-operation period of the image recording apparatus 30 to measure the total non-operation time by determining the cumulative non-operation time.

In the image recording apparatus 30 according to the present embodiment, when the controller 1 detects that the cumulative non-operation time detected by the timer 31 has reached a predetermined value, the controller 1 commands the test pattern generator 6 to produce a test pattern. Thereafter, correction data is produced in a similar manner as in the first embodiment described above. After completion of producing the correction data, the correction data is stored in the RAM 5, and the operation enters into a state in which inputting of image data is waited for. When producing of the correction data is completed, data indicating the cumulative non-operation time detected by the timer 31 is reset.

In the image recording apparatus 30 according to the third embodiment, as described above, advantages similar to those achieved in the image recording apparatus 10 according to the first embodiment described above are achieved. Furthermore, the third embodiment has an additional advantage that when the cumulative non-operation time has reached the predetermined value, correction data is automatically produced, and input image data is corrected using the correction data. This makes it possible to handle an recording position error due to a change in the state of nozzles of recording heads, without necessitating any special operation.

Although in the image recording apparatus 30 according to the third embodiment described above, the cumulative non-operation time is detected by the timer 31, the manner of operation is not limited to that. For example, a cumulative operation time of the image recording apparatus may be detected by the timer, and correction data may be produced when the cumulative operation time has reached a predetermined value. Alternatively, an elapsed time may be measured by the timer 31, and correction data may be produced when the elapsed time has reached a predetermined value. Still alternatively, correction data may be produced when a power switch of the image recording apparatus is turned on. In any case, correction data is automatically produced when a particular event occurs, thereby ensuring that the recording position error of input image is corrected before causing a problem, without necessitating any special operation.

Figure 6:
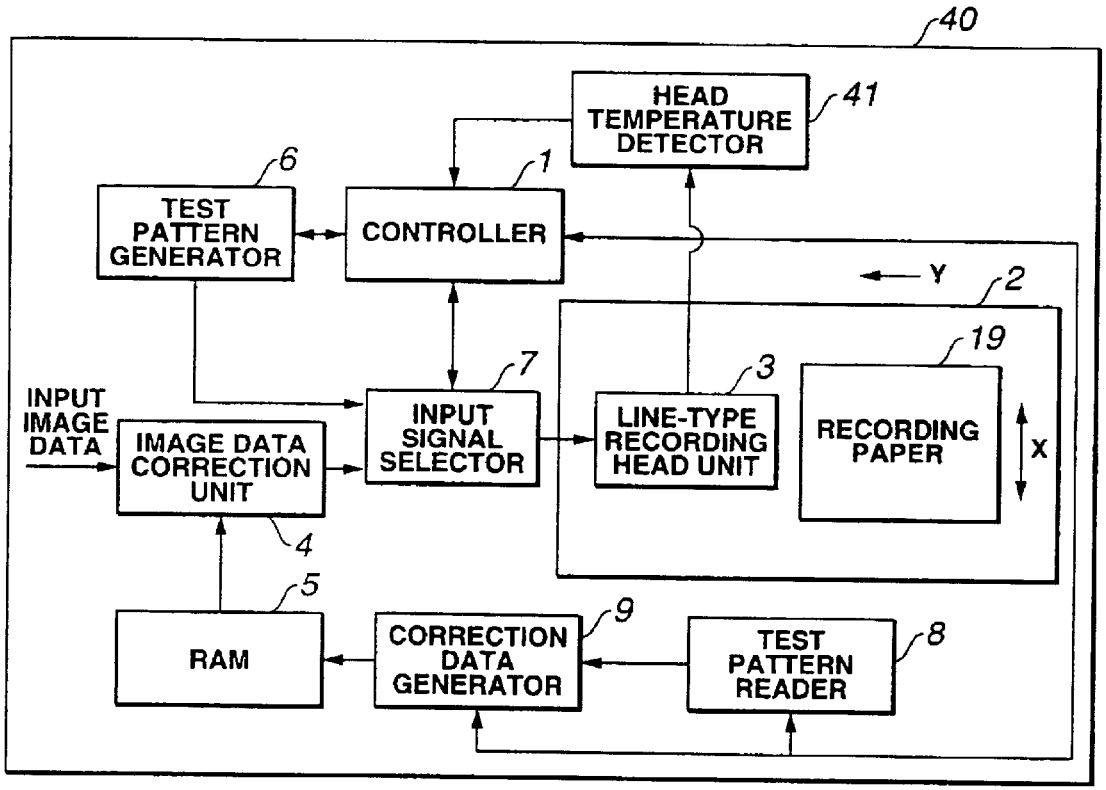
FIG. 6 is a block diagram showing a construction of an image recording apparatus according to a fourth embodiment of the present invention.

FIG. 6 is a block diagram showing a construction of an image recording apparatus according to a fourth embodiment of the present invention. In this fourth embodiment, similar parts to those in the first to third embodiments described above are denoted by similar reference numerals. In the following description, those similar parts are not explained again but different parts are explained.

The image recording apparatus 40 according to the fourth embodiment is similar to the image recording apparatus 10 according to the first embodiment described above except that the image recording apparatus 40 additionally has a head temperature detector 41.

The head temperature detector 41 detects temperature of the respective recording heads 11, 12, and 13 (FIG. 2) of the line-type recording head unit 3 and outputs information indicating the detected temperature to the controller 1.

In the image recording apparatus 40 according to the present embodiment, the temperate of each of the recording heads 11, 12, and 13 is always monitored by the head temperature detector 41. When the detected temperature has reached a predetermined value, the controller 1 commands the test pattern generator 6 to produce a test pattern. Thereafter, correction data is produced in a similar manner as in the first embodiment described above. After completion of producing the correction data, the correction data is stored in the RAM 5, and the operation enters into a state in which inputting of image data is waited for.

In the image recording apparatus 40 according to the fourth embodiment, as described above, advantages similar to those achieved in the image recording apparatus 10 according to the first embodiment described above are achieved. Furthermore, the fourth embodiment has an additional advantage that when the temperature of the recording head has reached the predetermined value, correction data is automatically produced, thereby ensuring that even if temperature causes a thermal expansion on a portion supporting the recording head or causes the state change of the nozzles, the effects of temperature are cancelled by the correction data thereby preventing the image recording position from being shifted.

Figure 7:
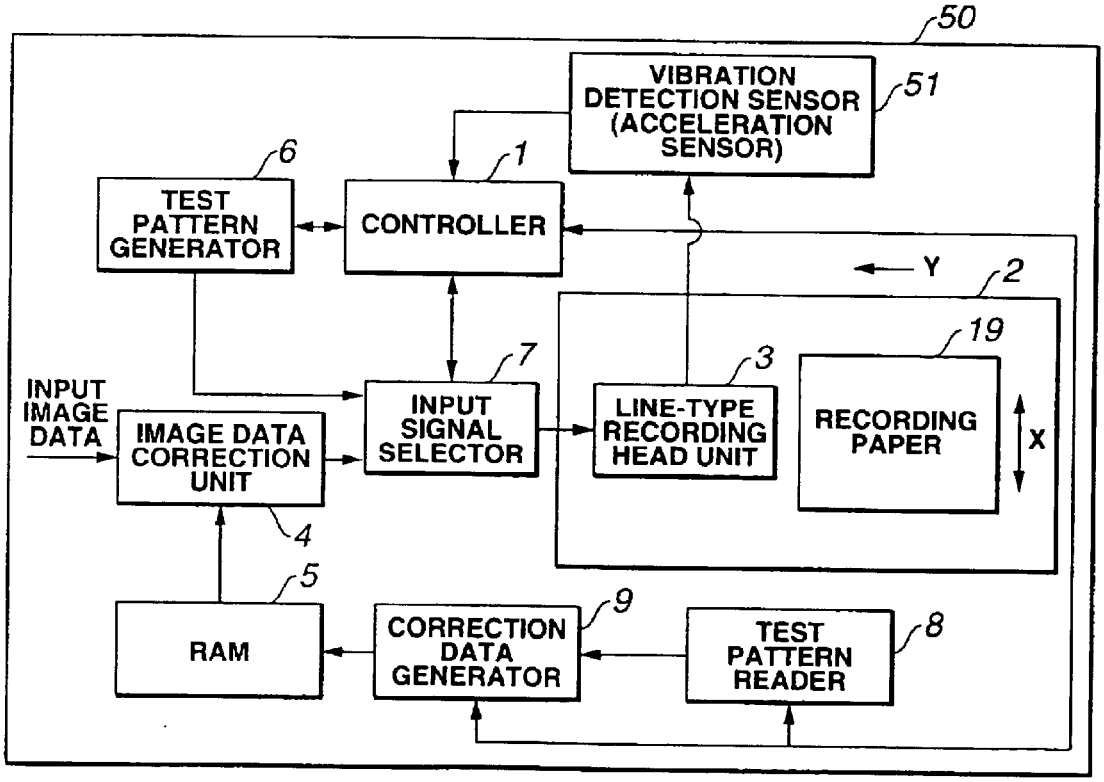
FIG. 7 is a block diagram showing a construction of an image recording apparatus according to a fifth embodiment of the present invention.

FIG. 7 is a block diagram showing a construction of an image recording apparatus according to a fifth embodiment of the present invention. In this fifth embodiment, similar parts to those in the first to fourth embodiments described above are denoted by similar reference numerals. In the following description, those similar parts are not explained again but different parts are explained.

The image recording apparatus 50 according to the fifth embodiment is similar to the image recording apparatus 10 according to the first embodiment described above except that the image recording apparatus 50 additionally has a vibration detection sensor 51.

The vibration detection sensor 51 is formed of, for example, an acceleration sensor and serves to detect a vibration or a mechanical shock applied to each recording head 11, 12, or 13 (FIG. 2) of the line-type recording head unit 3. Information indicating the vibration or the mechanical shock detected by the vibration detection sensor 51 is outputted to the controller 1.

In the image recording apparatus 50 according to the present embodiment, if the vibration detection sensor 51 detects a vibration or a mechanical shock with a magnitude equal to or greater than a predetermined value applied to the recording heads 11, 12, and 13, the controller 1 commands the test pattern generator 6 to produce a test pattern. Thereafter, correction data is produced in a similar manner as in the first embodiment described above. After completion of producing the correction data, the correction data is stored in the RAM 5, and the operation enters into a state in which inputting of image data is waited for.

In the image recording apparatus 50 according to the fifth embodiment, as described above, advantages similar to those achieved in the image recording apparatus 10 according to the first embodiment described above are achieved. Furthermore, the fifth embodiment has an additional advantage that when a vibration or a mechanical shock with a magnitude equal to or greater than the predetermined value applied to the recording heads is detected, correction data is produced thereby ensuring that even if the vibration or the mechanical shock applied to the recording heads causes a change in position or posture of nozzles which can result in an image recording position error, the change is corrected in accordance with the correction data thereby preventing the image recording position from being shifted.

Although, in the fifth embodiment described above, the correction data is produced when a vibration or a mechanical shock with a magnitude equal to or greater than the predetermined value is detected, the correction data may be produced at a different time. For example, the correction data may be produced when the cumulative value of acceleration applied to the recording head has reached a predetermined value.

Figure 8:
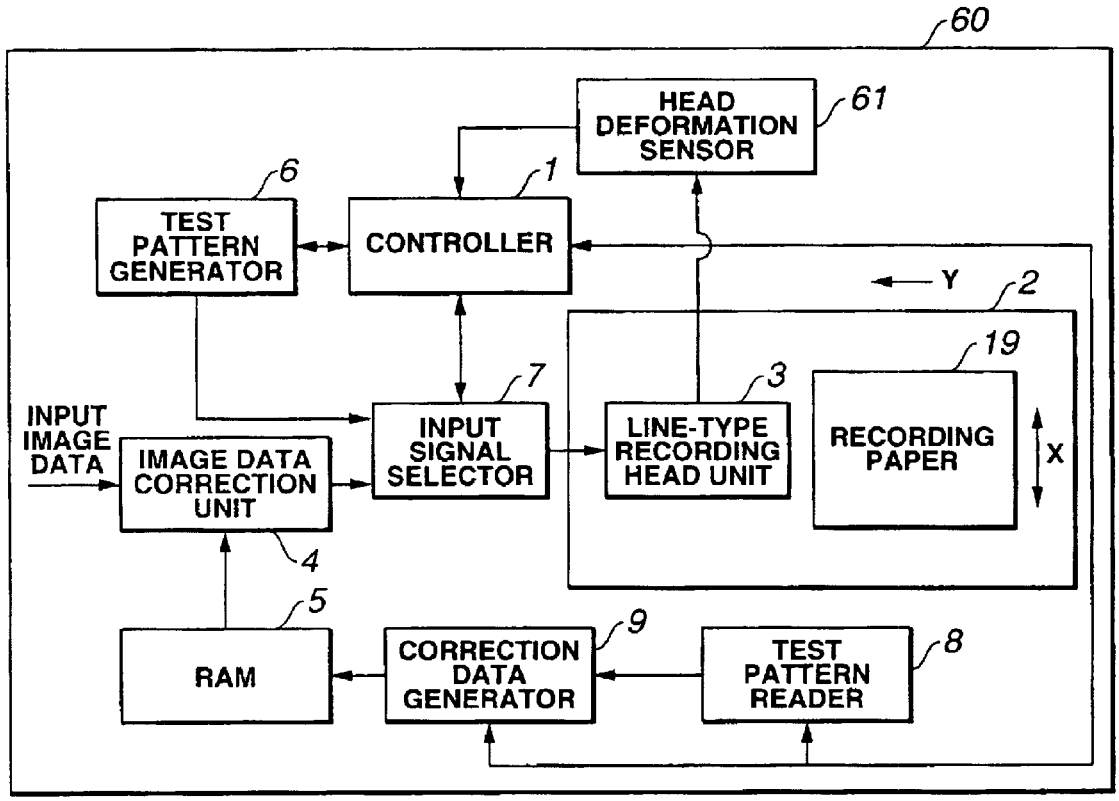
FIG. 8 is a block diagram showing a construction of an image recording apparatus according to a sixth embodiment of the present invention.

FIG. 8 is a block diagram showing a construction of an image recording apparatus according to a sixth embodiment of the present invention. In this sixth embodiment, similar parts to those in the first to fifth embodiments described above are denoted by similar reference numerals. In the following description, those similar parts are not explained again but different parts are explained.

The image recording apparatus 60 according to the sixth embodiment is similar to the image recording apparatus 10 according to the first embodiment described above except that the image recording apparatus 60 additionally has a head deformation sensor 61.

The head deformation sensor 61 is a sensor for detecting deformation of each of the recording heads 11, 12, and 13 (FIG. 2) of the line-type recording head unit 3. For example, a strain gauge or the like, which is a strain detection sensor, may be employed as the head deformation sensor 61. The output from the head deformation sensor 61 is supplied to the controller 1.

In the image recording apparatus 60 according to the present embodiment, when deformation, with a magnitude equal to or greater than a predetermine value, of one of the recording heads 11, 12, and 13 due to an external force applied thereto is detected by the head deformation sensor 61, the controller 1 commands the test pattern generator 6 to produce a test pattern. Thereafter, correction data is produced in a similar manner as in the first embodiment described above. After completion of producing the correction data, the correction data is stored in the RAM 5, and the operation enters into a state in which inputting of image data is waited for.

In the image recording apparatus 60 according to the sixth embodiment, as described above, advantages similar to those achieved in the image recording apparatus 10 according to the first embodiment described above are achieved. An additional advantage achieved in the sixth embodiment is that when deformation with a magnitude equal to or greater than the predetermined value is detected, correction data is produced and therefore the deformation is corrected according to the correction data thereby ensuring that an image is recorded in correct position even if positions or inclination of nozzles are changed due to the deformation of the recording head caused by the external force.

In the embodiments described above, it is assumed, for the purpose of simplicity, that the image recording apparatus has a monochrome line-type recording head unit 3 (that is, the image recording apparatus is a monochrome printer). The technique of correcting recording image position errors according to the present invention may also be applied to another type of an image recording apparatus such as an image recording apparatus (color printer) comprising a plurality of line-type recording head units capable of recording a color image.

Although in the above described embodiments, it is assumed that the image recording apparatus according to the present invention is an ink-jet printer, the present invention may also be applied to another type of image recording apparatus having recording elements for recording dots, such as a thermal transfer printer.

Having described the preferred embodiments of the invention referring to the accompanying drawings, it should be understood that the present invention is not limited to those precise embodiments and various changes and modifications thereof could be made by one skilled in the art without departing from the spirit or scope of the invention as defined in the appended claims.

What is claimed is:

1. An image recording apparatus for recording an image on a recording medium in accordance with an image signal, using a line-type recording head unit including a plurality of recording heads each having a plurality of recording elements disposed in a predetermined direction, the plurality of recording heads being disposed in substantially a same direction as a, direction in which the recording elements are disposed, and the plurality of recording heads being disposed such that there is an overlap in recording width between adjacent recording heads, the image recording apparatus comprising;

test pattern reading means for reading a test pattern image recorded by the respective recording heads;

image recording position error detection means for detecting, from the read test pattern, an error in image recording position for each recording element of each recording head relative to a predetermined image recording position;

correction data generation means for producing correction data for correction the error in image recording position for each recording element of each recording head in accordance with the recording position error detected by the image recording position error detection means;

correction means for correcting an image signal to be recorded by each recording element of each recording head, based on the produced correction data; and control means for operating the test pattern reading means, the image recording position error detection means, and the correction means at a particular time.

2. The image recording apparatus according to claim 1, wherein the particular time is a time at which at least one of the plurality of recording heads is exchanged.

3. The image recording apparatus according to claim 1, wherein the particular time is a time at which a fixing position of at least one of the plurality of recording heads is adjusted.

4. The image recording apparatus according to claim 1, wherein the particular time is a time at which a cumulative non-operation time has reached a predetermined value.

5. The image recording apparatus according to claim 1, wherein the particular time is a time at which a cumulative operation time has reached a predetermined value.

6. The image recording apparatus according to claim 1, wherein the particular time is each time at which a predetermined period has elapsed.

7. The image recording apparatus according to claim 1, wherein the particular time is a time at which a power supply of the image recording apparatus is turned on.

8. The image recording apparatus according to claim 1, wherein the particular time is a time at which a change in temperature of the recording head has become equal to or greater than a predetermined value.

9. The image recording apparatus according to claim 1, wherein the particular time is a time at which a temperature of the recording head has become equal to or higher than a predetermined value.

10. The image recording apparatus according to claim 1, wherein the particular time is a time at which deformation of the recording head equal to or greater than a predetermined value is detected by a deformation detection sensor disposed to detect deformation of the recording head.

11. The image recording apparatus according to claim 1, wherein the particular time is a time at which at least a vibration with a magnitude equal to or greater than a predetermined value is detected by a vibration detection sensor disposed to detect a vibration of the recording head.

12. The image recording apparatus according to claim 1, wherein the particular time is a time at which at least a cumulative value of acceleration detected by an acceleration sensor has become equal to or greater than a predetermined value.

13. The image recording apparatus according to claim 1, wherein the test pattern read by the test pattern reading means is recorded, in an area in which no overlapping of image recording range occurs among the recording heads.

14. The image recording apparatus according to claim 1, wherein the test pattern read by the test pattern reading means is a pattern including image areas which are recorded by the respective recording heads such that at least one of boundary lines of each image area can be distinguished and recognized for each recording head.

* * * * *